US010487718B2

(12) United States Patent
Alsayyed et al.

(10) Patent No.: US 10,487,718 B2
(45) Date of Patent: Nov. 26, 2019

(54) OVERFLOW CAP AIR VENT

(71) Applicant: Ford Global Technologies, LLC, Dearborn, MI (US)

(72) Inventors: Ali Alsayyed, Dearborn, MI (US); Robert Alex Mitchell, Plymouth, MI (US); Sandy Corbett, Rochester, MI (US); Scott Russo, Novi, MI (US); Jeannette Madej Richards, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 392 days.

(21) Appl. No.: 15/358,547

(22) Filed: Nov. 22, 2016

(65) Prior Publication Data

US 2018/0142606 A1 May 24, 2018

(51) Int. Cl.

| | |
|---|---|
| ***F01P 11/02*** | (2006.01) |
| ***B65D 41/04*** | (2006.01) |
| ***B65D 41/16*** | (2006.01) |
| ***B65D 47/32*** | (2006.01) |
| ***F01P 3/20*** | (2006.01) |
| ***B65D 51/16*** | (2006.01) |

(52) U.S. Cl.

CPC ..... *F01P 11/0285* (2013.01); *B65D 41/04* (2013.01); *B65D 41/16* (2013.01); *B65D 47/32* (2013.01); *B65D 51/1633* (2013.01); *B65D 51/1661* (2013.01); *F01P 3/20* (2013.01); *F01P 11/0238* (2013.01)

(58) Field of Classification Search

CPC ..... B60T 11/26; B65D 51/1633; B65D 47/32; B65D 51/1661; B65D 51/1611; F01P 11/0285

See application file for complete search history.

(56) References Cited

U.S. PATENT DOCUMENTS

| | | | | | |
|---|---|---|---|---|---|
| 2,258,019 | A * | 10/1941 | Kramer | B60T 11/26 | 137/43 |
| 3,296,396 | A * | 1/1967 | Stiward | B60T 11/26 | 200/84 R |
| 4,200,205 | A * | 4/1980 | Ban | B60T 11/26 | 188/345 |
| 5,347,813 | A * | 9/1994 | Yanagi | B60T 11/26 | 137/493.9 |
| 6,585,128 | B2 * | 7/2003 | Clevenger | F15B 1/26 | 220/303 |
| 7,048,140 | B1 | 5/2006 | Caldwell | | |
| 2002/0066714 | A1 * | 6/2002 | Mainquist | B65D 51/1633 | 215/261 |
| 2004/0011793 | A1 * | 1/2004 | Feigel | B60T 11/26 | 220/303 |
| 2005/0091950 | A1 | 5/2005 | Weaver et al. | | |
| 2010/0001001 | A1 | 1/2010 | Seline | | |
| 2013/0087564 | A1 * | 4/2013 | Lee | B60T 11/26 | 220/303 |
| 2018/0072294 | A1 * | 3/2018 | Gerber | B60T 11/16 | |
| 2018/0142606 | A1 * | 5/2018 | Alsayyed | B65D 41/04 | |

* cited by examiner

*Primary Examiner* — Shawn M Braden

(57) ABSTRACT

One general aspect includes a cap for a the overflow reservoir bottle, including a lower cup having a syncline void, said syncline void having by a wall extending above and below at least one surface of the lower cup. The cap also includes an upper cup with an anticline projection nesting adjacent to the syncline void of the lower cup, and said upper cup affixed to the lower cup, with at least one vent to permit gas to traverse the overflow reservoir bottle.

13 Claims, 4 Drawing Sheets

OVERFLOW CAP AIR VENT

BACKGROUND

Internal combustion engines commonly use an engine coolant to cool and maintain the operating temperature of the engine. As the coolant is routed through the engine, the coolant absorbs thermal energy from the engine causing the coolant to expand due to thermal expansion. The expanded coolant takes up more space in the engine and any excess volume (overflow) of engine coolant from the engine moves to an overflow reservoir bottle. Subsequently, the space for the air (air volume) inside the overflow reservoir bottle reduces and any air inside the bottle compresses. The compressed air inside the overflow reservoir bottle can be at a higher pressure than the air outside of the overflow reservoir bottle. This pressure differential causes the air to leave the bottle to bottle to equalize the air pressure between the inside and the outside of the bottle. The air leaves the overflow reservoir bottle usually via a neck/cap interface. In addition to air leaving the bottle, the coolant itself may slowly seep through the neck/cap interface as the coolant splashes and sloshes inside the overflow reservoir bottle, for example, as the vehicle traverses a bumpy road and the coolant inside the bottle is agitated and splashes near and possibly through the neck/cap interface. Any seepage may result in coolant getting collected on the outside of the overflow reservoir bottle, especially at a seam of the overflow reservoir bottle, giving the appearance of a recovery bottle or cooling system issue.

Therefore, the appearance problem can be avoided by pursuing an overflow reservoir bottle cap that would allow air to vent out of the overflow reservoir bottle while eliminating or reducing the engine coolant from splashing through the cap.

DETAILED DESCRIPTION

Introduction

Figure 1:
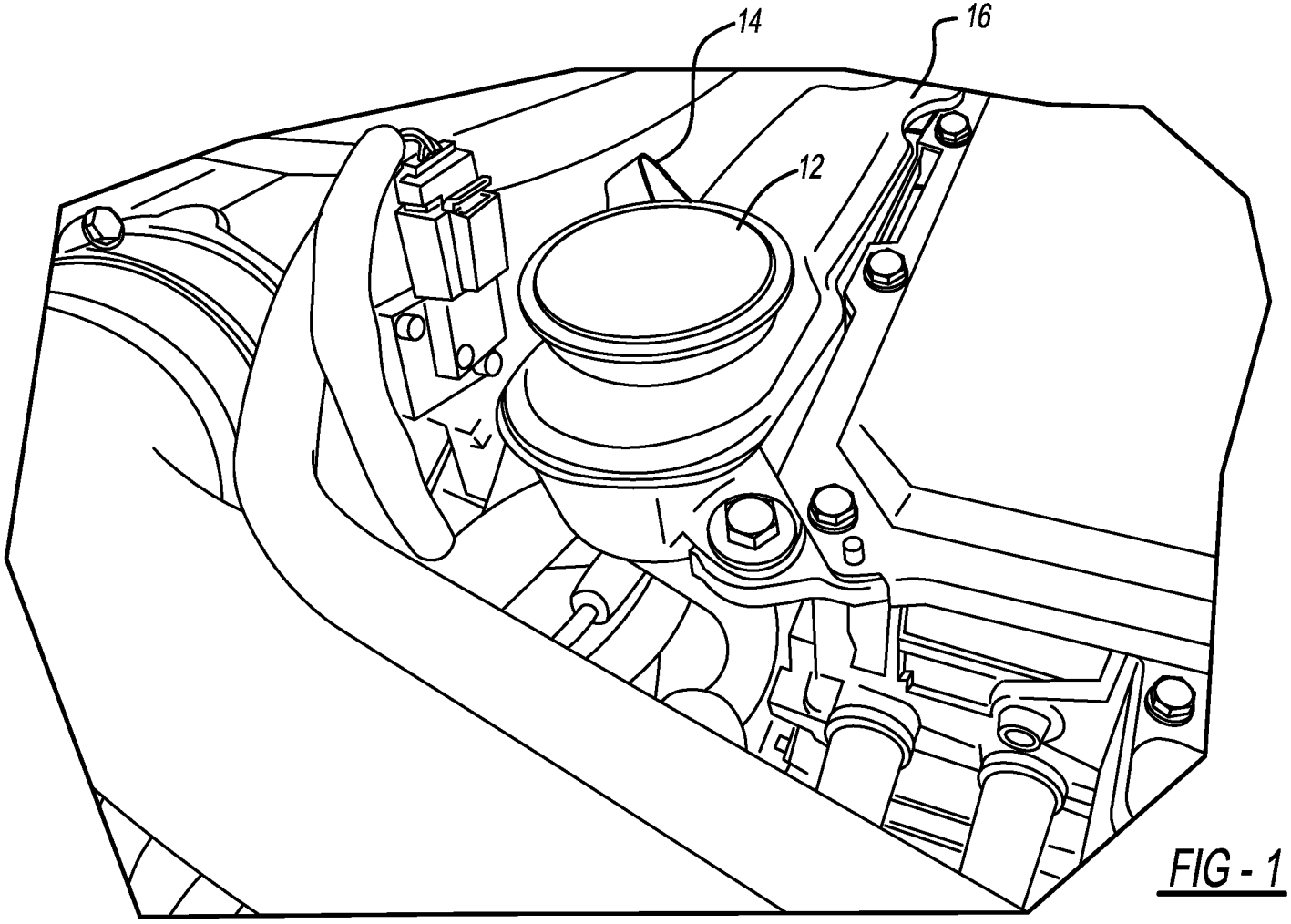
FIG. 1 is an illustration of an example of a recovery bottle's placement adjacent to a vehicle's engine.

With reference to the Figures, wherein like numerals indicate like parts throughout the several views, FIG. 1 is an example of an overflow reservoir bottle 16 and a prior art bottle cap 12 and its possible placement adjacent to a vehicle's (not fully shown) engine. The bottle cap 12 and may include a strap 14 to prevent a user from losing the bottle cap 12 when adding or checking a coolant level inside the overflow reservoir bottle 16.

Figure 2:
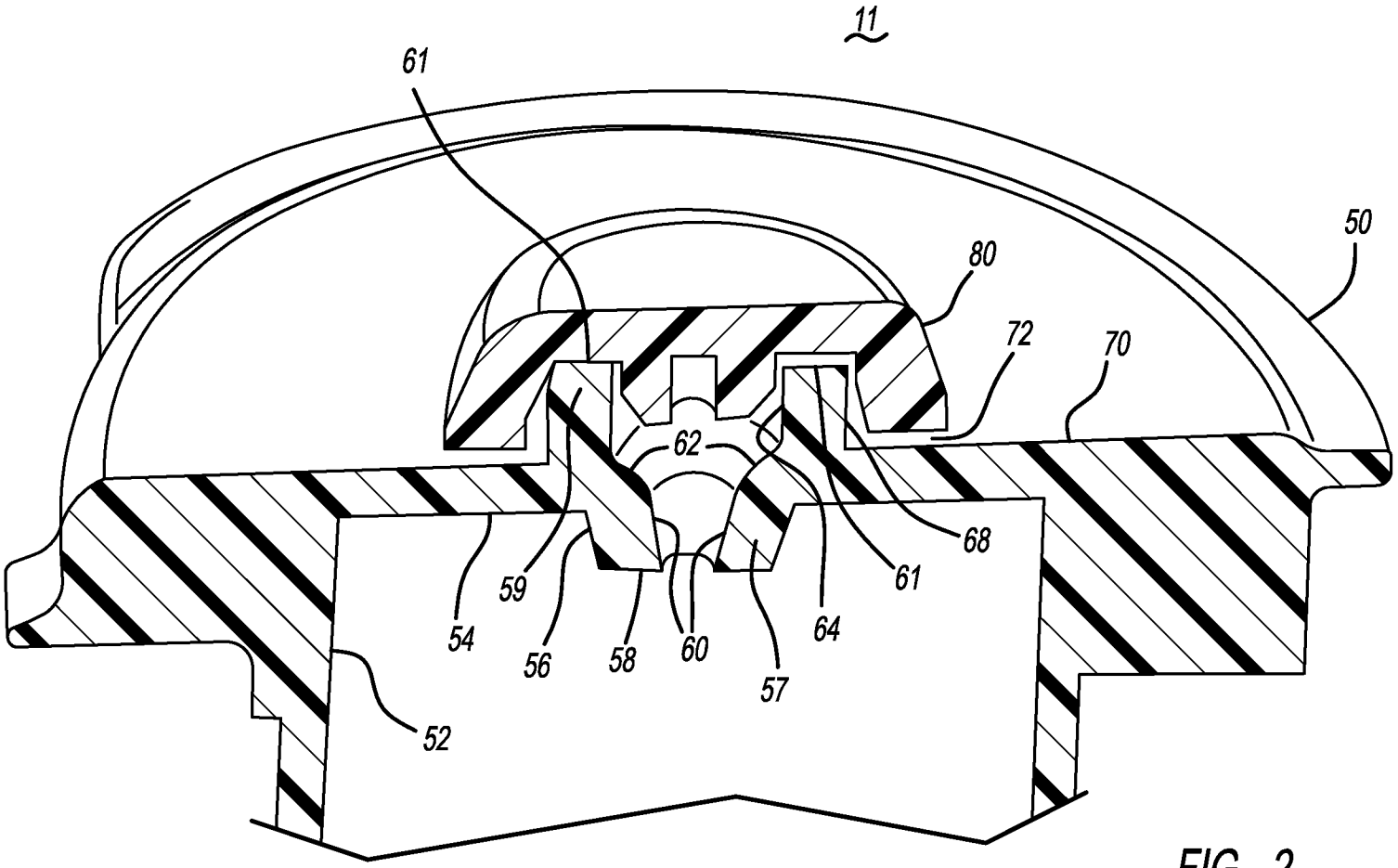
FIG. 2 is a cutaway view of a recovery bottle cap air vent.

Now with reference to FIG. 2, which illustrates a cutaway view of an embodiment of a recovery cap 11 having a lower cup 50 and an upper cup 80 adjacent to the lower cup 50. The lower cup 50 having a syncline void area defined by a sloped lower wall 57 which encircles the syncline void area on a first face 54 of the cup 50. An upper wall 59 may encircle the syncline void on a second face 70 and may have a variable height, thus permitting an adjustment to a volume of gas and a pressure of gas ingressing and egressing the overflow reservoir bottle 16. The lower cup 50 may include an inner side wall 52 adjoining the first face 54. The first face 54 joins an outer wall 56 of the sloped lower wall 57. The other end of the outer wall 56 adjoins a sloped wall lower face 58. An inner slope wall 60 defines a first area of the syncline void and is adjacent to the sloped wall lower face 58. The inner sloped wall 60 may be angled as shown in FIG. 2, for example, forming a conical shape and permitting any liquid residing in the inner sloped wall 60 to collect and drip back into the overflow reservoir bottle 16 of FIG. 1 when the recovery cap 11 is affixed to the overflow reservoir bottle 16. Any angular measurements are relative a perpendicular plane (not shown) which is perpendicular to the second face 70.

The inner sloped wall 60 is adjacent to a slope transition wall 62 and the slope transition wall 62 is adjacent to a lower cup inner vertical wall 64. The slope transition wall 62 may be further angled to aid with the collection and subsequent dripping back of any collected liquid into the overflow reservoir bottle 16. The lower cup inner vertical wall 64 is also adjacent to a horizontal wall 61 and in turn the horizontal wall 61 is to a lower cup outer wall 68, and the lower cup outer wall 68 is adjacent to the second face 70. The lower section of the lower cup 50 may include means to attach to the overflow reservoir bottle 16, for example, a means for a snap fastener to affix the recovery cap 11 on to the overflow reservoir bottle 16 or a means to screw the recovery cap 11 on to the overflow reservoir bottle 16, just to name a few.

Figure 3:
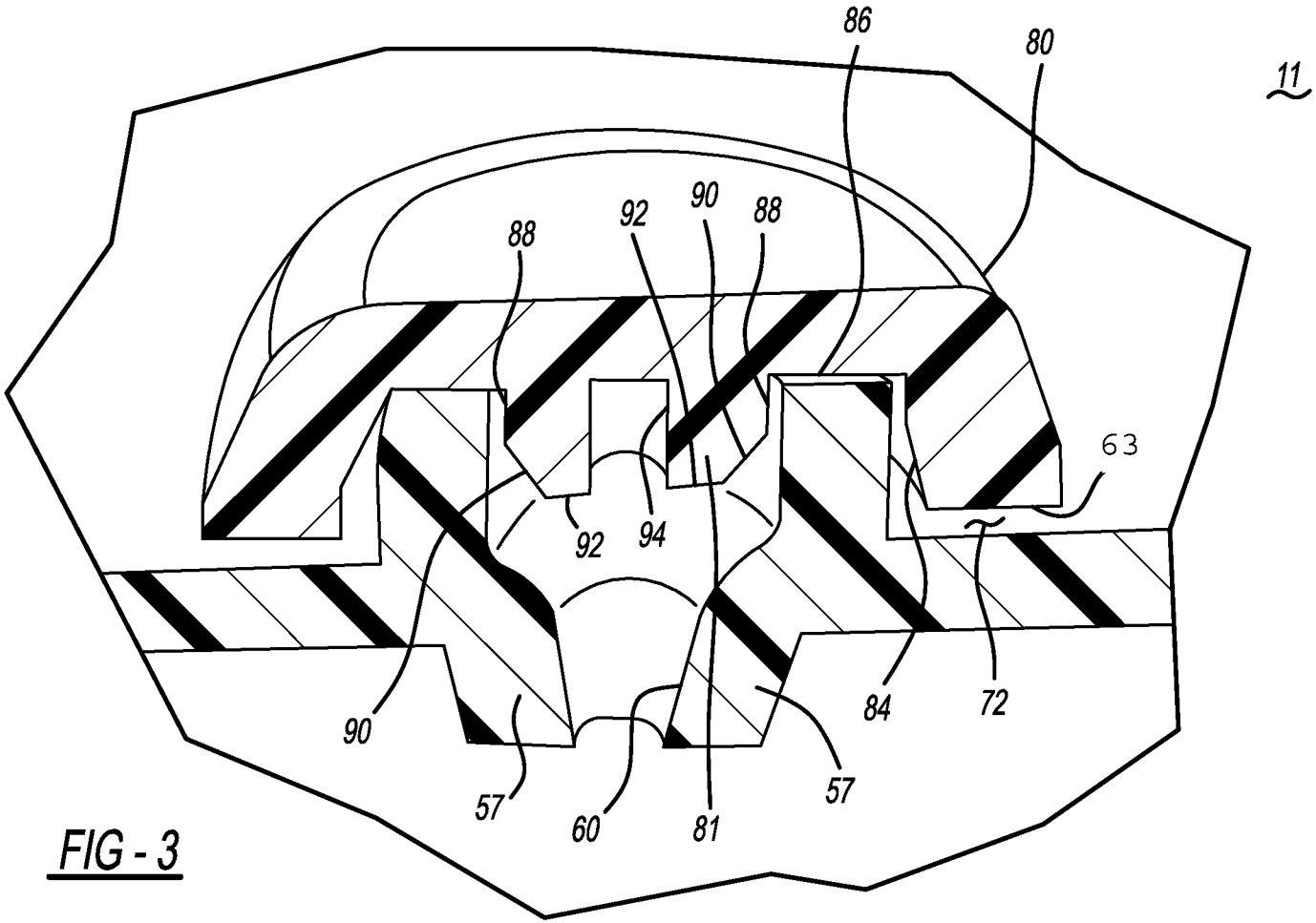
FIG. 3 is an enlarged view of the FIG. 2 illustrating details of the upper cup portion.

Now, with references to FIGS. 2 and 3, the upper cup 80 has an anticline projection 81 which matches up with the syncline void of the lower cup 50 when the upper cup 80 is placed adjacent to the lower cup 50. The projection 81 provides a surface for vapor to collect, condense back into a liquid, and eventually drip back into the overflow reservoir bottle 16. The upper cup 80 includes at least one lower surface 63 which attaches to the second face 70 of the lower cup 50. In other words, the lower surface 63 may be flush with the second face 70, however, some or of the lower surface 63 is be in contact with the second face 70. A second void in form of a vent 72 is purposely included to permit the ingress and egress of gas through the recovery cap 11 from the overflow reservoir bottle 16.

The upper cup 80 further includes an upper cup first inner wall 84 adjacent to the lower surface 63. The upper cup first inner wall 84 is also adjacent to an upper horizontal inner wall 86, and the upper horizontal inner wall 86 is also adjacent to a second inner wall 88. The second inner wall 88 is also adjacent to an upper cup inclined wall 90. The upper cup inclined wall 90 may also aid in the collection of liquid and cause it to drip down to either the lower cup 50 or the overflow reservoir bottle 16. The upper cup inclined wall 90 is further adjacent to an inner lower horizontal wall 92. The second inner wall 88, the upper cup inclined wall 90, and the inner lower horizontal wall 92 make up the substantial portions of the projection 81.

In an embodiment, the projection 81 may include a third void, for example, a notch 94, which increases the surface area of the projection 81. The added surface area provided by the notch 94 permits an increase the amount of collected liquid, e.g., engine coolant vapor, thus permitting the liquid, once condensed to drip back into the overflow reservoir bottle 16.

Figure 4:
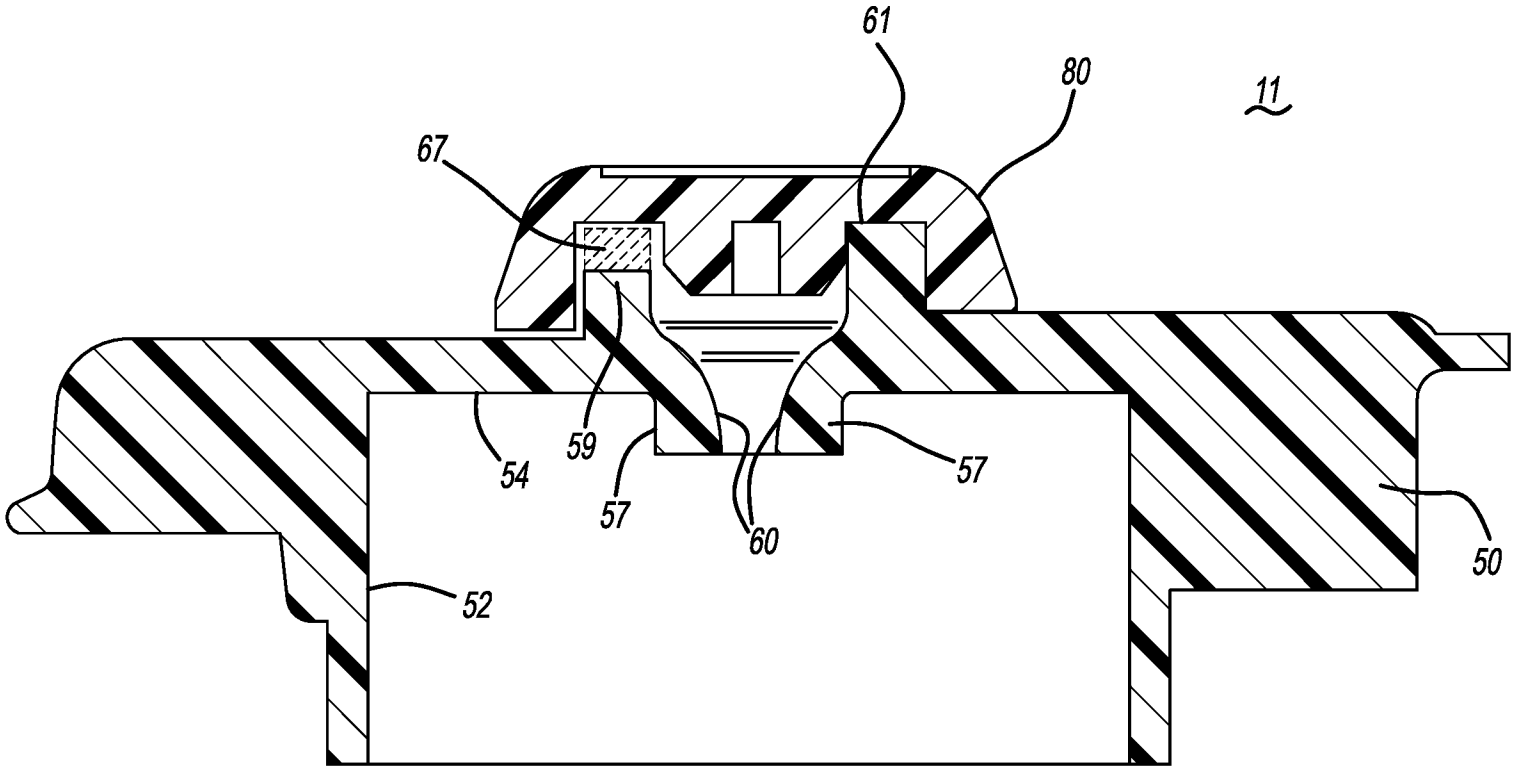
FIG. 4 is a view of an additional embodiment of the overflow cap air vent.

Now with reference to FIG. 4, the lower cup 50 may have different heights of the lower cup inner vertical wall 64 and the corresponding upper wall 68. The corresponding horizontal wall 61 will then also have a different offset from the upper cup 80. The varying offset heights may be a smooth linear change, e.g., a ramp like transition or may be stepwise change having several plateaus between the lowest and heights heights of the lower cup inner vertical wall 64 and the corresponding upper wall 68. In any case, a gap 67 may be adjusted to control the rates of gasses ingressing and egressing the overflow reservoir bottle 16.

In an embodiment, the outer wall 56 and portions of the inner slope wall 60 are omitted from the lower cup 50, thereby making said sloped wall lower face 58 a continuation of the first face 54. In other words, the said void defined by the sloped lower wall 57 does not extend below the first face 54, only the upper wall 59 above the cup 50 second face 70.

The upper cup 80 is affixed to the lower cup 50 by at least one of a plastic weld, an adhesive bond and a mechanical fastener. Plastic welding, also known as sonic welding, is a process of uniting softened surfaces of materials, generally with the aid of heat (except solvent welding). Welding of plastics is accomplished in three sequential stages, namely surface preparation, application of heat and pressure, and cooling. Numerous welding methods have been developed for the joining of semifinished plastic materials. Based on the mechanism of heat generation at the welding interface, welding methods for thermoplastics can be classified as external and internal heating methods.

Adhesive bonding is a technique which applies an intermediate layer to connect substrates of different materials. Adhesive bonding has the advantage of relatively low bonding temperature as well as the absence of electric voltage and current. The mechanical fastener deploys a hardware device that mechanically joins or affixes two or more objects together.

To attach the recovery cap 11 to the overflow reservoir bottle 16, the recovery cap 11 may have a thread pattern (not shown) and the overflow reservoir bottle 16 would have a corresponding thread pattern (not shown) permitting the recovery cap 11 to be affixed to the overflow reservoir bottle 16. Alternatively, to attach the recovery cap 11 to the overflow reservoir bottle 16, the recovery cap 11 may have a snap type device (not shown) and the overflow reservoir bottle 16 would have a mating snap receiver (not shown) permitting the recovery cap 11 to be affixed to the overflow reservoir bottle 16.

Conclusion

As used herein, the adverb "substantially" modifying an adjective means that a shape, structure, measurement, value, calculation, etc. can deviate from an exact described geometry, distance, measurement, value, calculation, etc., because of imperfections in the materials, machining, manufacturing, sensor measurements, computations, processing time, communications time, etc.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

What is claimed is:

1. A recovery cap for an overflow reservoir bottle, comprising:

a lower cup having a syncline void defined by an upper wall extending above a surface of the lower cup and an outer wall extending below a surface of the lower cup; and an upper cup with an anticline projection nesting adjacent to the syncline void of the lower cup, the upper cup being affixed to the lower cup, wherein a first distance defines a vent to permit gas to traverse the overflow reservoir bottle provided between a first horizontal wall of the upper wall and the upper cup and wherein a second distance is defined between a second horizontal wall of the upper wall and the upper cup, the first distance and the second distance being different.

2. The cap of claim 1, wherein the upper cup is affixed to the lower cup by at least one of a plastic weld, an adhesive bond and a mechanical fastener.

3. The cap of claim 1, wherein the anticline projection further includes a notch to increase a surface area of the anticline projection.

4. The cap of claim 1, wherein a lower wall extending below a lower surface of the lower cup is at a first angle relative a perpendicular plane to said at least one surface of the lower cup.

5. The cap of claim 4, wherein a first upper wall extending above a second face of the lower cup is at a second angle relative the perpendicular plane to said at least one surface of the lower cup.

6. The cap of claim 5, wherein a second upper wall extending above the second face of the lower cup is at a third angle relative the perpendicular plane to said at least one surface of the lower cup.

7. The cap of claim 1, wherein the lower cup has a thread pattern to attach the cap to the overflow reservoir bottle.

8. The cap of claim 1, wherein the lower cup has a snap fastener to attach the cap to the overflow reservoir bottle.

9. A system to prevent loss of a liquid from an overflow reservoir bottle, comprising:

means for the overflow reservoir bottle to permit a gas to ingress and egress the overflow reservoir bottle via a cap with a lower cup having a syncline void defined by an upper wall and an outer wall, and an upper cup attached to the lower cup with an anticline projection nesting adjacent to the syncline void of the lower cup, a first distance defining a vent to permit gas to traverse the overflow reservoir bottle provided between a first horizontal wall of the upper wall and the upper cup and a second distance defined between a second horizontal wall of the upper wall and the upper cup, the first distance and the second distance being different.

10. The system of claim 9, further including means for attaching the lower cup to the upper cup via at least one of a plastic welding and an adhesive bonding and a mechanical fastening.

11. The system of claim 9, wherein the anticline projection further includes a notch to increase a surface area of the anticline projection.

12. The system of claim 9, further including means for screwing the cap on to the overflow reservoir bottle.

13. The system of claim 9, further including means for attaching the cap to the overflow reservoir bottle via a snap fastener.

* * * * *